US005884402A

United States Patent [19]

Talavera

[11] Patent Number: 5,884,402

[45] Date of Patent: Mar. 23, 1999

[54] HAIR TRIMMING DEVICE FOR REMOVAL OF SPLIT ENDS

[76] Inventor: Victor C. Talavera, 2412 Victoria Cir., Alpine, Calif. 91901

[21] Appl. No.: 774,387

[22] Filed: Dec. 30, 1996

[51] Int. Cl.[6] ..... B26B 19/00

[52] U.S. Cl. ..... 30/124; 30/30

[58] Field of Search ..... 30/124, 30

[56] References Cited

U.S. PATENT DOCUMENTS 5,461,780 10/1995 Morana ..... 30/30

5,519,939 5/1996 Smith ..... 30/30

*Primary Examiner*—M. Rachuba

*Attorney, Agent, or Firm*—Donn K. Harms

[57] ABSTRACT

A hair trimming device for cutting substantially equal portions of hair from only the distal end of hair shafts. The device features the brush like body having a handle end portion and a head end. The head end has a cooperating slot formed therein to cooperatively receive a selectively biased roller about the interior of the slot. Strands of hair are placed between the slot in the head end of the body and the roller wherein the user depresses a roller actuating lever at the handle end of the body. Depressing of the lever depresses the roller into the slot by rotating a cooperating mechanism connected to both the roller and lever causing the roller to depress. The user inserts hair strands between the raised roller and slotted side of the head end and thereafter the roller sinks into the slot at a predetermined bias to put optimum tension on the hair strands. The device is then pulled through the hair in a brush like fashion causing only the distal ends of hair moving between the roller and slot to rise into a cutting blade wherein substantially equal portions of the end of the individual hairs are removed while leaving adjacent longer hair strands uncut until their ends are drawn through the device.

11 Claims, 5 Drawing Sheets

HAIR TRIMMING DEVICE FOR REMOVAL OF SPLIT ENDS

BACKGROUND OF THE INVENTION

1. Field of the Invention

The present invention relates to a device for the trimming of hair. More particularly it relates to a device which will trim a predetermined substantially equal amount of hair from the ends of individual hair shafts distal from the hair follicles of the scalp, for removal of split ends. The ends of the hair shafts are thus trimmed while leaving adjacent longer hair shafts in tact.

2. Prior Art

Because of changing styles and the inevitability that hair on a person's head will grow and need to be cut, visits to hairstylists and barbers are a common occurrence in the United States and throughout the world. Hairstylists and barbers are trained in the art of cutting hair, to the specifications of their clients, using motorized and hand held implements such as scissors.

However, one vexing problem exists, whether the hair on a person's head is being styled by trained stylists, or when individual getting hair trimmed. Split ends are a constant and continued product of combing and brushing of hair. They cause the hair to look unhealthy as well as unfashionable.

The current method of trimming split ends, either by the highly trained stylist or the amateur involves a time-consuming process. The hair must be stretched relatively taut using the hand or a comb or combinations thereof, and then, delicately trimmed, only on the ends of the individual hair strands. An errant cut will yield hash marks, uneven cuts, or other undesired results in the head of hair of the person being trimmed.

Split ends are an especially vexing problem in the case of shoulder-length and longer hair styles worn by women and men. Because of the varying length of the strands of hair involved from the ears down to the shoulder or below, it is especially time consuming to try and trim only the ends of the hair a very small relatively equal amount while not accidentally cutting long adjacent strands. Hours can be spent by professional stylists trying to trim such heads of hair of their split ends. It is virtually impossible for persons with long hair to trim the split ends themselves as cutting only one-eighth to one-quarter of an inch of hair, on the back of one's head, using a mirror and scissors, is a task fraught with peril. One slip and the hair style could be ruined by cutting some very long strands of hair lying adjacent to the distal split ends on shorter hair shafts.

A number of devices have developed over the years for trimming hair for use by amateurs as well as professional hair stylists. Such devices attempt to allow armatures to cut hair into professional looking styles or to enhance the ability of professional stylists by giving them another tool for their trade.

While many devices address the issue of cutting hair and styling it, few devices address the issue of split ends on the distal ends of hair strands and removing such split ends and other unhealthy distal ends which are not split but are unattractive, bleached, or otherwise damaged. Further, on very long hair, even if the ends are not split, aged distal hair shaft ends are often removed as a cosmetic aid to beatifying the head of hair getting rid of frizzy and unattractive hair ends. To remove such damaged or unattractive hair shaft ends without ruining the hair style of the individual or causing major change in styles requires that only short pieces of the distal ends of hair shafts be cut off without disturbing longer adjacent healthy normal appearing hair shafts. This can be a very tedious, if not an impossible task, with the hundreds of thousands of hairs on individual heads.

U.S. Pat. No. 5,519,939 (Smith) teaches a combination of a rotating brush, combs, and razor blades arranged to cut a broad swath of hair when in use. However, Smith requires many adjustments to work with the individual using it and is intended to cut long pieces of hair as determined by the circumference of the rotating brush. Smith because of this arrangement cannot be configured to cut only one-eighth to one-quarter of an inch of hair off only the ends of shafts in a relatively equal amount as is required to trim split ends and unhealthy or unattractive hair ends. Further, because it is drawn through the hair by hand to rotate the brush, the user is in a constant peril of having hair strands wrap around the brush into a tangle or of pulling the device sideways through the hair and accidentally cutting off broad swatches of adjacent hair shafts in long or varying lengths.

U.S. Pat. No. 3,015,336 (Caples) teaches an apparatus combining combing a vacuum cleaner and scissors to cut hair. While Caples in practice could aid the user in the cutting of only split ends from the hair follicles, it still requires that someone such a professional stylist draw the hair into the vacuum tool and then hand-cut each end, an equal amount, with scissors. Further, uneven amounts are easily cut from each shaft causing long hairs as well as just ends to be cut.

Such an arrangement would not work well for persons trying to cut their own hair as cutting their hair behind their head would require the use of a mirror and removing relatively equal amounts from each hair would be tricky at best. Further, as taught, Caples requires the use of two hands, the eyes, and two different tools. These tools for Caples are designed to cut longer and varying lengths of the ends of portions of hair from the head once drawn into the vacuum tool and drawing only one-eighth to o-quarter of an inch of each hair into the tool and then cutting only that portion off would require great skill to avoid drawing more into the tool by accident.

U.S. Pat. No. 3,115,143 (Queen) teaches a guide for trimming hair whereby a user can taper or feather the cut of the hair from the neckline to the temples. Queen however requires holding the guide in one hand and an electric razor in the other. Such an arrangement precludes use by do-it-yourself home hair stylists and requires the constant attention and skill of a stylist or second person to cut the hair of the person on which the device is being used. It would be virtually impossible for a user to cut the hair on the back of his head in this manner and Queen by its own teaching addresses tapering or feathering of haircuts rather than just the removal of split ends. Further, it would also be virtually impossible without great effort and time, to cut only a substantially equal portion from the distal end of each individual hair while leaving adjacent longer hairs untouched with this device.

U.S. Pat. No. 5,213,116 (Stein) teaches a hair trimming device using a rotatable blade on a comb like a guide. Stein is however designed to cut bangs rather than split ends and because as taught it requires two hands to use it is unlikely that anyone could use it one the back of the head without the aid of another person to guide the device. Again, trimming substantially equal amounts from only the distal ends of hairs would be extremely time consuming and require great dexterity if it could be accomplished.

As such, there exists a need for an easily and inexpensively manufactured apparatus, which can safely by used to cut the substantially equal very short length of hair involved in the removal of split ends and unhealthy or unattractive hair ends from the individual hairs on a person's head. Such a device should also be capable of trimming the hair or fur of animals who frequently require a trim for appearance or the sake of a healthy coat.

An additional need exists for such a device that needs little or no adjustments once adjusted to remove the short length required to accomplish this task. A further requirement needed for such a device, is the ability to use it with only one hand, by either a professional hair stylist, or, at home by a person wishing to trim split ends. Additionally such a device should require little or no force to be exerted by the user and the sum of its parts should function as a unitary mechanism requiring no additional tools such as scissors. Little dexterity, hair cutting skill, or finger manipulation by the user should be required to operate such a device.

Finally, such a hair trimming device should accomplish the heretofore tedious task of trimming a substantially equal portion of only the distal ends of individual hair shafts in a short amount of time, without cutting adjacent long hair shaft center sections or substantially long pieces of adjacent hair strands.

SUMMARY OF THE INVENTION

Applicant's device is an easily manufactured and operated device for the trimming of the substantially equal short pieces of hair from the distal end of individual hair shafts of a person's head. The device will remove these hair portions which form split ends or unattractive or unhealthy hair ends, while leaving adjacent shafts of longer hair length uncut until the device reaches the distal ends of those strands.

In use by an amateur or a professional the user can achieve heretofore unachievable successful results in removing only the distal ends of damaged or unattractive hair strands from all over a head of hair. Such an ability is especially helpful for individuals with shoulder-length and longer hair where the risk of cutting off adjacent long hair follicles to the split end being cut is extreme or with individuals who wish to keep the look and style of their current haircut but remove the ends of the damaged or unsightly hairs. The person desiring to remove unsightly split ends from his or her head, simply grips the handle of the brush like body of the device, places hair between the roller and the handle, and then allows the cylindrical roller to locate to position in a cooperating slot or aperture formed in the body or handle with the hair strands therebetween.

The user, with hair located between the body and roller descended into the cooperating slot then pulls the brush like handle end of the body through the hair and substantially equal portions of the distal ends of hairs are removed by a cutting mechanism in communication with the slot in the body. As needed, the biasing of the roller may be changed or reversed for ease of use by the use of gears, hinges, and different types of springs or combinations thereof using differing manufacturing techniques.

As the user pulls the handle, the hair glides between the tensioning roller biased and the cooperating slot in the handle and the hair strands are pulled over the biased roller. When the distal end of individual hair strands clear the edge of the brush handle face and reach and clear the leading edge of the roller, the strands pop up for a short amount of time depending on how fast the device is pulled through the hair. A cutting mechanism such a conventional circular scissors blade, a conventional reciprocating blade, or a conventional foil razor blade apparatus, in communication with the slot formed in the handle, slices a predetermined substantially equal length, of hair strands, unusually less than a half inch long, from the distal ends of the individual strands of hair which pop up. A screen located at the bottom of the slot in the body has apertures therethrough and the distal ends of the hairs pass though these apertures for cutting by the blade mechanism. However, this screen may not be necessary with some cutting mechanisms, or, could also be part of the body if conventional reciprocating blades or foil type, or similar cutting blades are used for the cutting mechanism.

The amount of hair removed from the distal ends of hair strands can be extremely small and is dictated by a function of the diameter of the roller and the distance from the roller to the cutting blade. All the other longer strands of hair are protected at their mid sections as they are encompassed between the biased roller and the handle and grip following the perimeter of the roller a safe distance from the cutting mechanism. The only pieces of hair cut are thus substantially equal short pieces of the distal ends of the individual strands which pop up upon reaching the leading edge of the roller and are at that time inserted through the screen or aperture at the bottom of the cooperating slot to be cut off by the cutting blade.

Thus even an inexperienced hair stylist can cut the split ends of his or her hair by simply placing the hair strands between the roller and brush like a handle, and pulling the device though the hair in a brushing-like fashion. Cutting the rear of the head is just as simple and only requires one hand and a gentle pulling action through the hair. Skill, professional training, and dexterity requirements are minimal to operate the devices.

The electric motor powering the cutting blade arrangement can be powered by conventional flashlight or rechargeable batteries located in the brush like handle and connected to the motor or by house current using a conventional wire plugged into a wall socket or by some combination thereof. As mentioned earlier, the cutting mechanism can be a conventionally used cutting blade such as a reciprocating blade, a vibrating blade, a foil razor mechanism, a rotating circular blade mechanism or other conventional blades used in hair trimmers, razors and shavers in cooperating with the screen if needed at the bottom of the slot in the handle or in cooperation with a cooperating blade or scissor.

In summary, the present invention is an improvement over devices now in use and known in prior art. It is novel and satisfies a long unmet need for an easily and inexpensively manufactured trimmer which can be used by amateur or professional haircutter alike, with a minimum of dexterity and skill, and removes only unsightly or unhealthy distal hair ends with minimum risk of cutting adjacent longer hair shafts during the process.

The preferred configuration of the best current embodiments of the invention feature a body or a handle molded from conventional plastic or other materials used in most brush handles. A slot or indention aperture of a determined diameter and depth to is cut into the face of the handle in a size determined to cooperate with a roller or elongated rod which will occupy a position selectively locatable by a communicating lever, into or out of the slot, in a manner which the roller, the handle, or combinations thereof are biased as needed for ease of use. An electric motor conventionally attached to and powered by conventional flashlight or rechargeable batteries or standard AC power or combinations thereof provides power to a cutting mechanism selectively placed at a distance from the roller calculated to cut a selected length of hair from only the distal ends of hair drawn through the device. The cutting is accomplished when distal hair ends pass through a screen or aperture located at the bottom of the cooperating slot in the body and are cut off individually in relatively equal portions by a conventionally used cutting mechanism. The split ends and unsightly or unhealthy ends are thus trimmed substantially equally with little skill or dexterity in a motion equivalent to brushing ones hair.

The short amount of hair cut from the distal ends of the hair strands drawn through the slot and around the roller edge is determined by a function of the diameter of the roller and the distance from the roller to the cutting blade. The larger the roller and cooperating slot and closer to the cutting mechanism, the longer the length of hair removed from the distal ends individual strands. Distance from the roller to the cutting mechanism can also be adjusted using a screw or gear mechanism to cut more or less off the ends. It is envisioned that the roller distance to the screen and/or cutting mechanism would be adjustable on some models of the invention using an adjustable stop for the roller to position farther or closer to the cutting blade through the aperture or screen in slot depending on the length of hair desired for removal. This is accomplished with a screw or worm gear and cam or other conventional adjustment device placed in a working relationship with the operating hinge or gears for the roller or by adjusting the distance of the roller inside the handle.

An object of this invention is providing an easily used and maintained apparatus to cut only the distal ends of hair strands removing substantially equal portions only from the distal end of each hair shaft so cut.

Another object of this invention is to provide the additional benefit of a device that can cut very short relatively equal lengths of hair from the distal end of hair shafts growing from the scalp on a person's head while avoiding cutting longer and other strands also drawn through the device.

Another object of this invention is to provide a hair cutting device easily operable with only one hand requiring little skill, training, or dexterity.

A further object of this invention is to provide an easily operated hair cutting device which once adjusted for desired cutting length requires little or no adjustment and yields professional results when used by armatures.

An additional object of this invention is to provide a hair cutting device which can be safely operated by users without injury.

Additionally, an object of this invention is to provide a device which can cut the hair of the user with one hand and requires no additional scissors or tools to yield the cut.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENT OF THE INVENTION

Figure 1:
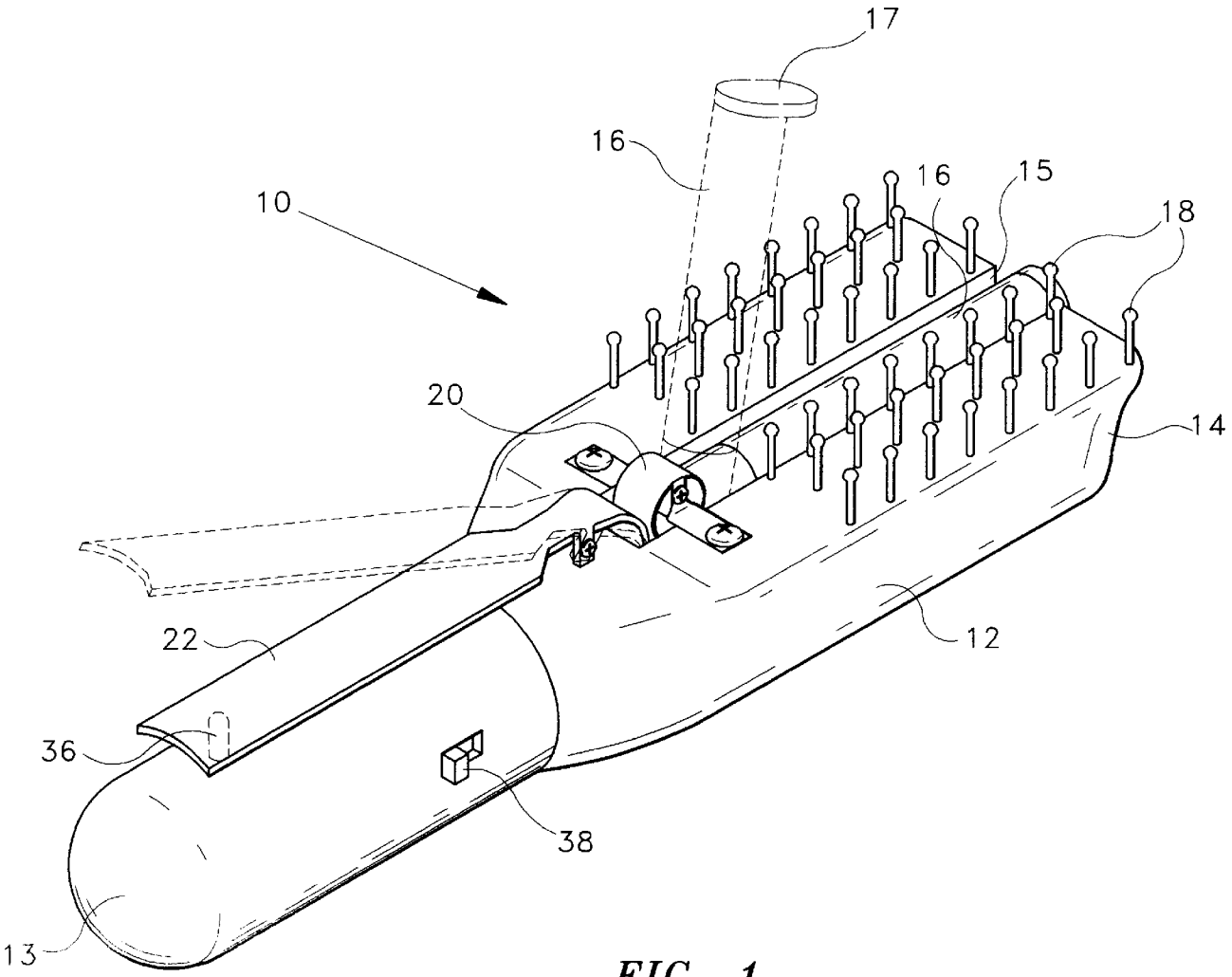
FIG. 1 is a perspective view of the face of the body or brush like handle of the hair cutting device showing the elongated roller in a biased position in a cooperating groove cut in the handle body and in phantom the activating lever in a second biased position for insertion of hair between the roller and the brush face.
Figure 3:
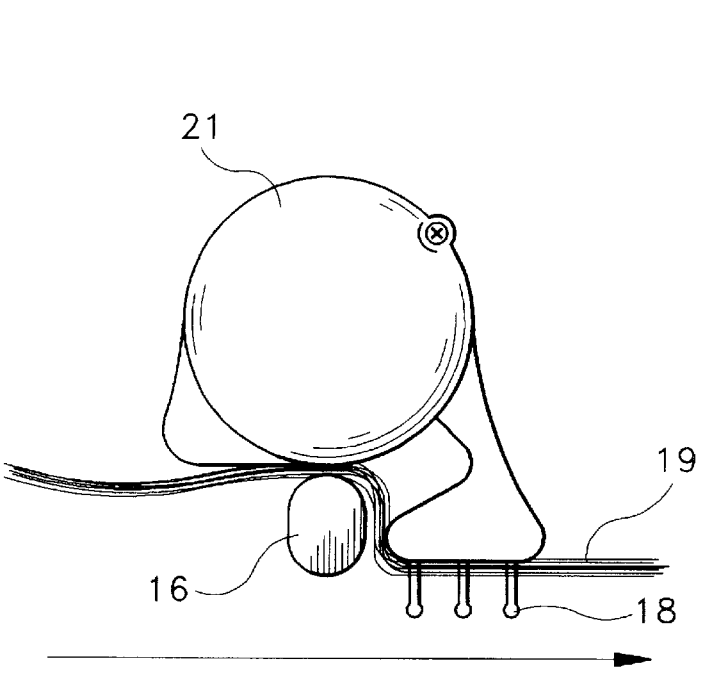
FIG. 3 is a side view of the invention showing hair drawn between the face of the brush like handle and biased roller with only one shoulder on the body instead of two and with the end cap closed.

Referring now to the drawing FIGS. 1 through 8 depict a current preferred embodiment of the invention rendering the hair trimming device 10 featuring the brush like body 12 having a handle end portion 13 and a head end portion 14 of the body 12. The head end portion 14 has a cooperating slot 15 formed therein to cooperatively received a biased roller 16 about the interior of the slot 15. One or two shoulders 15*a* and 15*b* are formed on either side of the slot in the face of the head end portion 14 of the body 12.

The roller 16 can be fixed or rotate on an axle about its interior. An optional roller end 17 can be placed at the distal end of roller 16 to help maintain hair in the slot 15 during use. Hair guides 18 help guide hair strands 19 between the roller 16 when positioned in the slot 15 during use.

Two methods of biasing the roller 16 are currently used in the invention. One method features the roller 16 biased in a position outside the slot 15 such that the user places strands of hair between the slot 15 in the head end portion 14 of the body 12 and the roller 16 wherein the user depresses a roller actuating lever 22 at the handle end portion 13 of the body 12. The depressing of the lever 22 depress the roller 16 into the slot 15 by rotating a hinge mechanism 20 connected to both the roller 16 and lever 22 causing the outwardly biased roller 16 riding on an axle 19 of hinge mechanism 20, to depress into slot 15 when the outwardly biased lever 22 is depressed. Biasing springs 30 or other conventional biasing means are used to bias the roller 16 and cooperating lever 22 away from the face portion of the device.

Another embodiment of the invention features the roller 16 biased into a position inside the slot 15. In this embodiment a cooperating gear arrangement 28 raises the roller 16 from their position biased inside the slot 15 by a spring or other conventional biasing means when the actuating lever 22 is depressed and rotates the gear attached about an axle 19. The user in this mode would raise the roller 16 from the slot 15 and insert hair between the raised roller 16 and the slot 15 and face or slotted side of the head end portion 14 and thereafter allow the roller 16 to sink into the slot 15 at a predetermined bias to put optimum tension on the hair strands moving through the slot 15 and around the face of the roller 16. As noted earlier the roller 16 can also be biased in reverse mode outside the slot and thus require the lever 22 to position the roller into the slot 15. With optional conventional gearing 28, other combinations of operation can be achieved if desired. A conventional adjustment stop or screw (not shown) can also be added to adjusted the depth the roller 16 is drawn into the slot 15 thus adjusting cut length of the hair ends 26 cut as the distance of the roller 16 from the blade 24 can be increased or decreased in this manner.

In its resting position the actuating lever 22 would be above the handle end portion 13 of the body 12 a sufficient distance to allow the user to grip the handle end portion 13 for running the device through the hair like a brush. A deadman's switch 36 can optionally be placed under the lever 22 to cut off power to the device when not properly gripped by the user. Another conventional electric switch 38 is in the handle end portion 13 to turn the motor 32 which attaches to and powers the cutting blade 24 on and off. The switch may be located anywhere on the body that is convenient to manufacture and for operation of the device.

Figure 2:
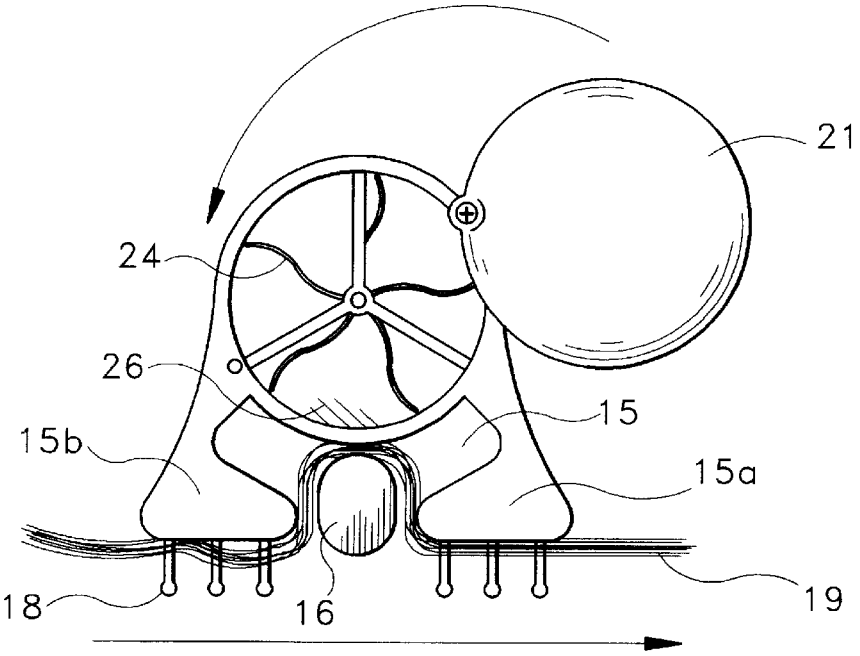
FIG. 2 is an end view of the device showing the roller in the slot in the body with hair being drawn therethrough. The end cap is open revealing the blade inside the handle body and showing hair traversing the screen located in the bottom of the slot and to allow for cleaning.
Figure 4:
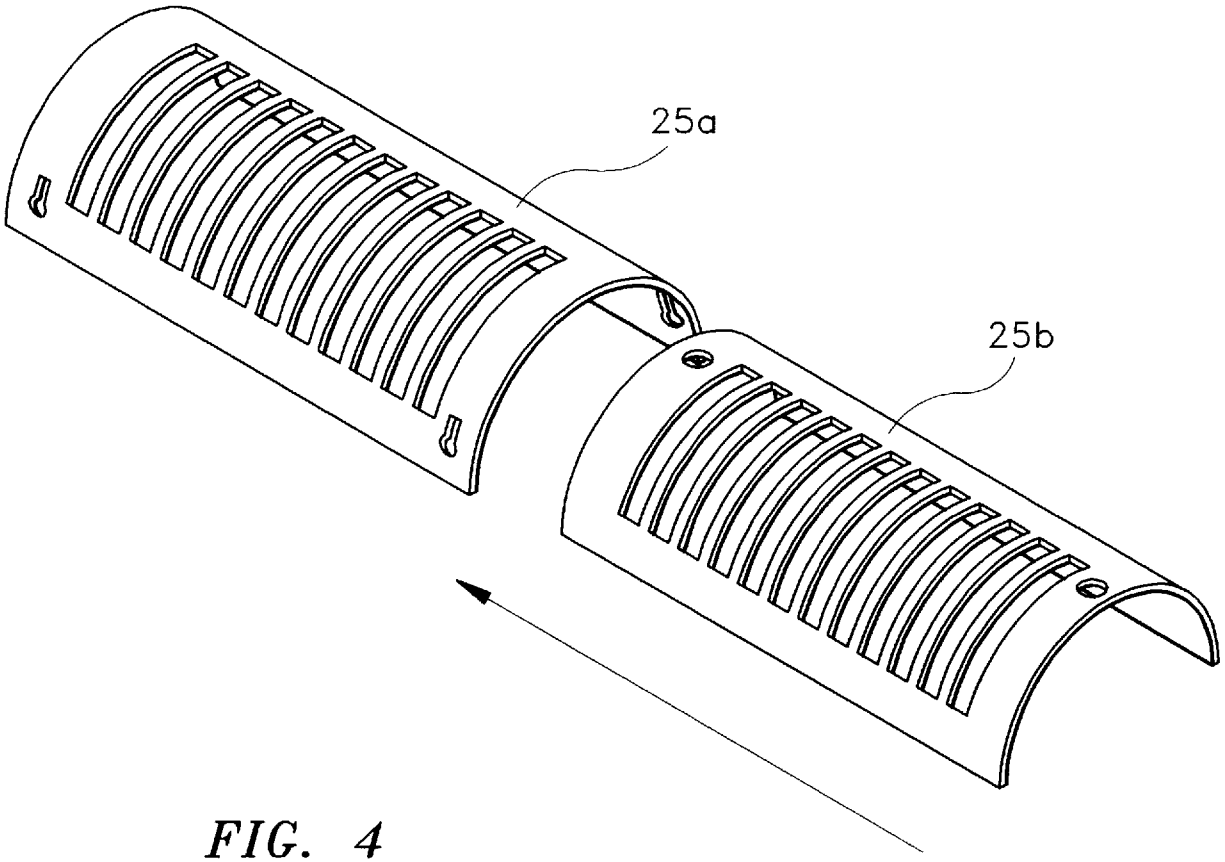
FIG. 4 is a perspective view of the screen to be located in the bottom of the slot and a cooperating reciprocal cutting blade which cuts substantially equal portion of each end of individual hair strands in using a conventional cutting blade.
Figure 5:
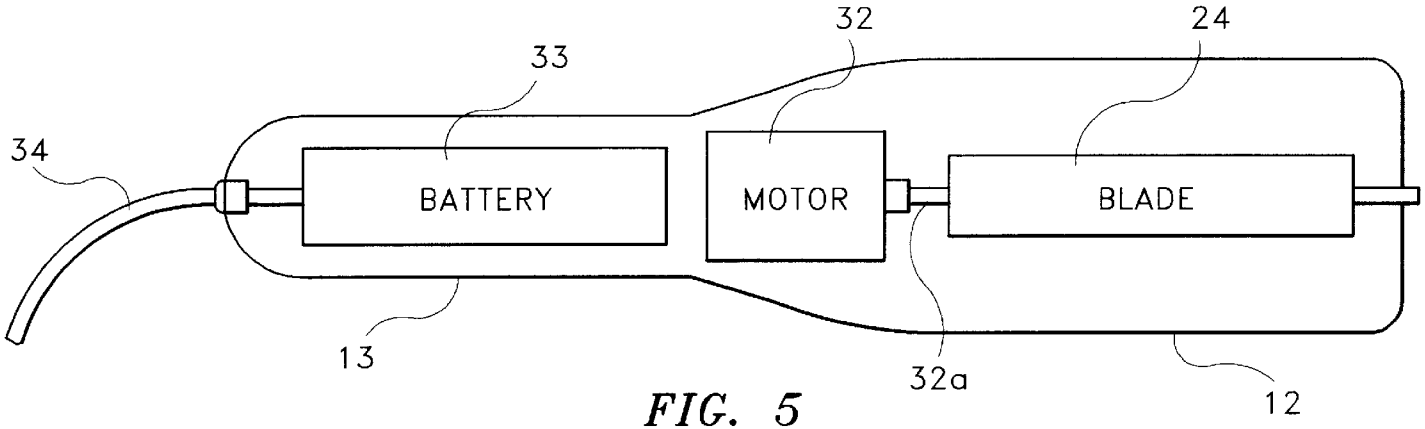
FIG. 5 is a side view of the device showing the relation ship of the conventional cutting blade attached to the motor powered by a battery, or rechargeable battery, or AC power or combinations thereof.
Figure 6:
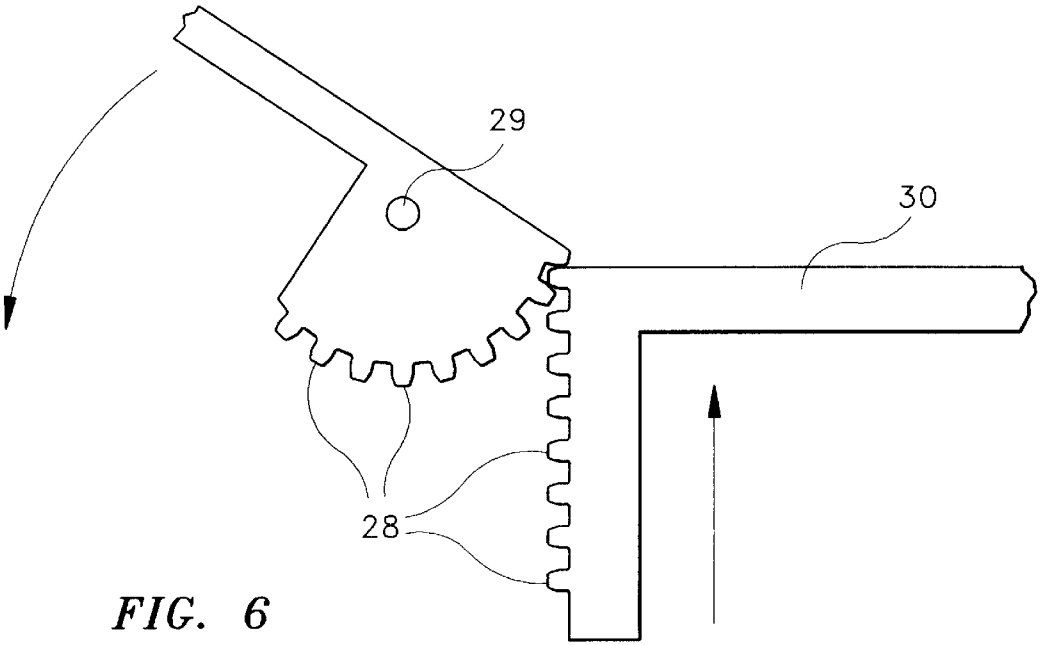
FIG. 6 is a side view of the activating of a cooperating gear type of mechanism to raise and lower the roller away from and into the slot.
Figure 7:
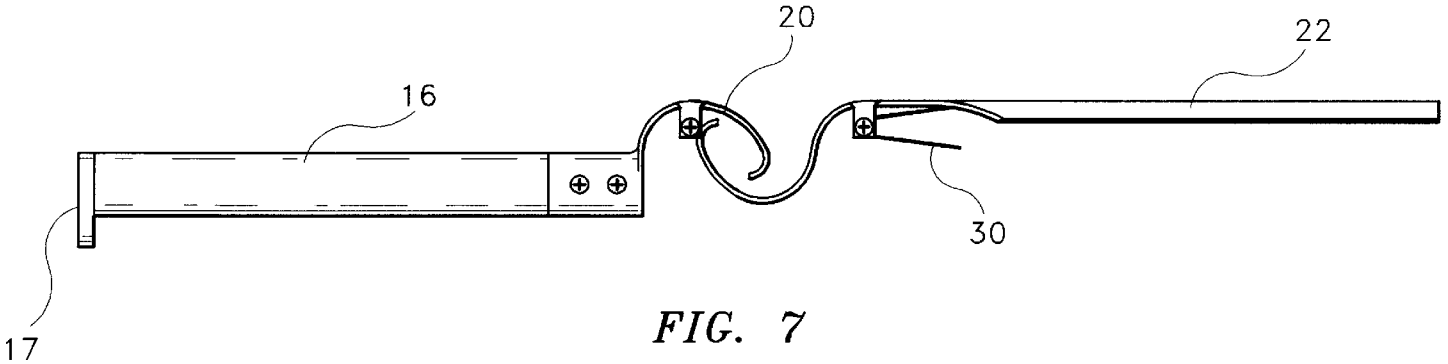
FIG. 7 and 8 depicts a side view of a cooperating hinge apparatus to raise and lower the roller from the handle slot.
Figure 8:
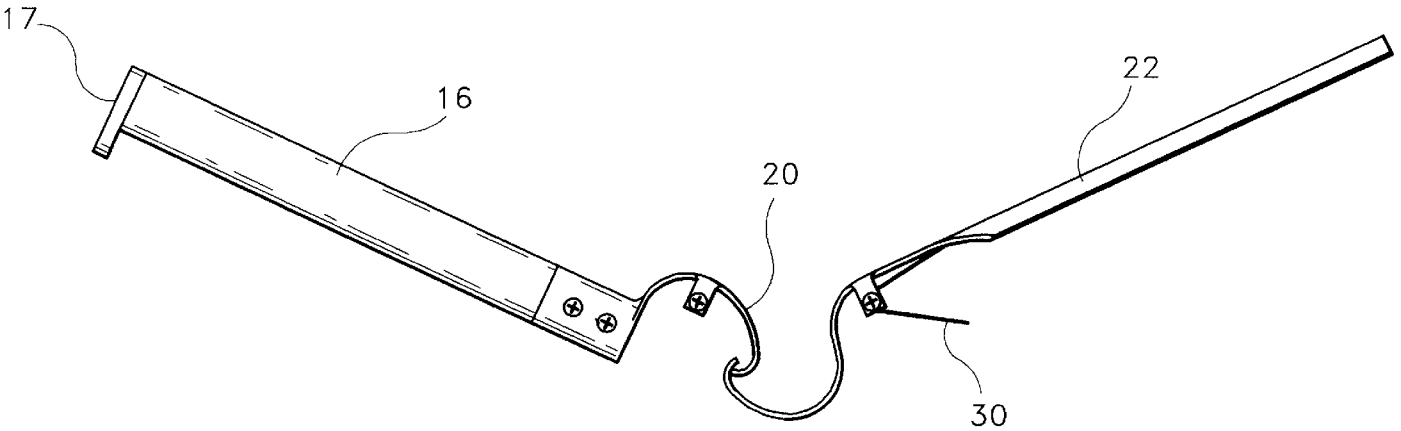

FIG. 2 is an end view of the device during operation. Hair strands 19 are drawn into the area of the slot 15 and between the roller 16 and the slot 15 in the face of the head end portion 14 portion of the body 12 by placing hair therein in and closing the roller 16 into the slot in the aforementioned manner and then pulling the body 12 in a brush like fashion through the hair in the direction noted. As hair strands 19 are pulled over the roller 16, the hair ends 26, of those strands 19 pop up when they reach the leading edge of the roller 16. The ends 26 which rise up and into the cutting mechanism are therein cut off by the blade 24 or 25*a* when they rise through apertures located in a screen 25. The pieces so cut from each hair strand 19 are substantially equal in length. The blade may be any conventionally used blades in shavers and hair cutters such as a rotating blade 24, a reciprocating blade arrangement 27 using screen 25 and reciprocating blade 25*a* as a scissor blade against screen 25 as one part of a cutting blade. Alternatively, additional reciprocating blades 25*a,* forming a cutting apparatus, may be positioned behind the screen. A conventional foil razor or other similar conventional hair cutting blades might also be used to cut the hair strands 26 communicating through the apertures 23 in the screen 25.

In this manner, users of the device can easily cut off the damaged or unsightly ends of their hair. This is accomplished by simply placing hair into the device, and pulling the device through the hair in a conventional brushlike fashion. In this manner, substantially equal portions of the distal ends 26 of hair strands are easily removed from the remainder of the hair strands without injuring or cutting adjacent mid sections 19 of other hair strands.

Power for the motor 32 may be provided by conventional rechargeable or flashlight batteries 33 which are directly charged using available AC current through a chord 34 or charged by an induction process on a mount, or the device can just be powered by conventional AC type current while being plugged into a wall socket with a cord 34. Of course conventional combinations of these power sources can be used including an automotive power source being attached to the cord 34 instead of AC power.

While all of the fundamental characteristics and features of the hair trimming device for removal of split ends of hair strands have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A hair trimming apparatus for trimming the distal ends of hair drawn therethrough, comprising:

a body, said body having a head end portion and a handle end portion;

a slot in said head end portion of said body;

a guide mechanism for guiding said hair strands through said body, comprising;

a roller, said roller dimensioned for cooperative parallel engagement with said slot;

said roller having an operating position recessed within said slot;

said roller having a raised position disengaged from said slot;

an actuating lever;

a hinge mechanism mounted to said body, said hinge mechanism connected to one end of said actuating lever and also to one end of said roller, said hinge mechanism communicating movement of said actuating lever to said roller, such that, movement of said actuating lever causes said roller to move between said operating position and said raised position;

a gap formed between said roller and said slot when said roller is in said raised position, said gap sufficient in size for insertion of said hair strands between said roller and said slot; and a path for said hair strands inserted through said gap, said path formed across said head portion of said body, around said roller and between said roller and said slot when said roller descends to said operating position; and a cutting mechanism consisting of:

an aperture in said slot, said aperture communicating with a cavity inside said head portion, said aperture allowing said distal ends of said hair strands drawn through said path to momentarily communicate through said aperture into said cavity; and a cutting blade positioned inside said cavity to cut substantially equal portions of said distal ends of said hair strands communicating through said aperture.

2. The invention as defined in claim 1 wherein said cutting mechanism is powered by an electric motor in an operational engagement with said cutting blade, said electric motor having a power source communicating required electrical power thereto.

3. The invention as defined in claim 2 wherein said power source is a flashlight battery.

4. The invention as defined in claim 2 wherein said power source is conventional alternating current.

5. The invention as defined in claim 2 wherein the power sourced is a rechargeable battery.

6. The invention as defined in claim 1 additionally comprising hair strand guides located upon said body adjacent to said slot.

7. The invention as defined in claim 1 where in wherein said cutting blade is a reciprocating blade.

8. The invention as defined in claim 1 wherein said cutting blade is a rotating blade.

9. The invention as defined in claim 1 additionally comprising, said hinge mechanism providing a pivot point for said actuating lever, gears on one end of each of said actuating lever and said roller, said gears being cooperatively engaged, wherein a pivot of said actuating arm causes said roller to move between said operating position and said raised position.

10. The invention as defined in claim 1 additionally comprising a biasing means, said biasing means biasing said roller to one of said operating position or said raised position.

11. The invention as defined in claim 1 wherein said apertures are located in a screen, said screen mounted to said body about said slot.

* * * * *